US005740024A

United States Patent [19]

Johnson et al.

[11] Patent Number: 5,740,024

[45] Date of Patent: Apr. 14, 1998

[54] TWO-STAGE, HIGH VOLTAGE INDUCTOR

[75] Inventors: Nathaniel M. Johnson, Laconia; Edward Neister, New Dunham, both of N.H.

[73] Assignee: Zero Emissions Technology Inc., Portsmouth, N.H.

[21] Appl. No.: 759,966

[22] Filed: Nov. 27, 1996

Related U.S. Application Data

[63] Continuation-in-part of Ser. No. 417,130, Apr. 5, 1995, Pat. No. 5,629,842.

[51] Int. Cl.[6] ..... G05F 1/455

[52] U.S. Cl. ..... 363/44

[58] Field of Search ..... 363/44, 28–29, 363/124; 307/1, 2, 52; 323/271, 281–282

[56] References Cited

U.S. PATENT DOCUMENTS

| | | | |
|---|---|---|---|
| 1,340,027 | 5/1920 | Dunham . | |
| 4,290,003 | 9/1981 | Lanese | 323/247 |
| 4,390,831 | 6/1983 | Byrd et al. | 323/240 |
| 4,587,475 | 5/1986 | Finney, Jr. et al. | 323/241 |
| 4,694,387 | 9/1987 | Walker | 363/56 |
| 4,760,484 | 7/1988 | Walker | 361/18 |
| 5,255,178 | 10/1993 | Liberati | 96/80 |
| 5,378,978 | 1/1995 | Gallo et al. | 323/241 |

FOREIGN PATENT DOCUMENTS

| | | |
|---|---|---|
| 0208822 | 1/1987 | European Pat. Off. . |
| 2590071 | 5/1987 | France . |
| 1074098 | 1/1960 | Germany . |
| 1108308 | 6/1961 | Germany . |
| 1614470 | 9/1970 | Germany . |

OTHER PUBLICATIONS

Patent Abstracts of Japan, vol. 010, No. 217 (E–423), Jul. 29, 1986, Ricoh Co. Ltd., Reducing Method of Radiation Noise of High Voltage Device.

*Primary Examiner*—Aditya Krishnan
*Attorney, Agent, or Firm*—Phillip E. Decker

[57] ABSTRACT

An improved two-stage, high voltage inductor assembly. The inductor assembly is particularly adapted for use in a power supply circuit for an electrostatic precipitator. The inductor assembly includes a first inductor member defined by a plurality of turns of a continuous length of wire, and a second inductor member defined by a plurality of ferrite beads in end-to-end relationship. The assembly changes the electrical characteristics of power generated by a power supply to increase the output voltage, decrease ripple, and decrease the amount of power required. The assembly also reduces the arcing and sparking which normally occurs, improving the collection time and efficiency of the precipitator.

17 Claims, 6 Drawing Sheets

TWO-STAGE, HIGH VOLTAGE INDUCTOR

This is a continuation-in-part of application Ser. No. 08/417,130, filed Apr. 5, 1995 U.S. Pat. No. 5,629,842.

BACKGROUND a. Field of the Invention

The present invention relates to inductors, and more particularly to inductors for use in high frequency, high voltage circuits, such as, for example, the output stage of the power supply circuit for an electrostatic precipitator.

b. Description of the Related Art

Electrostatic precipitators have taken on considerably greater importance in recent years, particularly in view of the increased emphasis upon maintaining a clean environment. That increased importance includes the need for more effective air pollution control by maintaining clean exhausts from industrial processes that involve either the combustion of fuels or the reaction or transformation of materials in chemical processing operations that result in the generation of particulate matter as a consequence of carrying out the process. The techniques and structural elements incorporated in modern electrostatic precipitators, particularly the electrical control apparatus for controlling the power provided for imparting a charge to the particulate matter to be collected, as well as the power provided to the collection surfaces, have been continually refined to more completely remove undesirable particulate materials from stack gases and also to provide longer useful operating life for the precipitator components. The stack gases in connection with the electrostatic precipitators are often necessary to meet environmental regulations include chemical process and cement plant exhaust gases, fossil fuel electric generating plant exhaust gases, and exhaust gases from steam generation boilers, such as those commonly associated with paper mills for processes such as paper web drying, where scrap "black liquor" from wood processing operations and other fossil fuels are often the fuel sources.

The theory behind the operation of an electrostatic precipitator involves the generation of a strong electrical field through which stack gases pass, so that the particulates carried by the stack gases can be electrically charged. By charging the particles electrically they can be separated from the gas stream and collected, and thereby not enter and pollute the atmosphere. The generation of such electrical fields requires electrical power supplies that can provide a high DC voltage to charge the particulate matter and thereby permit its collection. The existing systems are most often based upon AC corona theory, using a single phase transformer-rectifier (T/R) set to rectify AC power to DC power and provide a high DC potential between a charging electrode and a collection surface, usually a plate, to charge the particles by subjecting the stack gases to the maximum possible current without complete breakdown. That approach is believed to produce the maximum efficiency in effecting removal of such particles.

The emphasis in particulate removal is generally placed on increasing the current flow between a grid and a plate defining the electrostatic precipitator collection surfaces, to a current level that produces a maximum of sparking between the grid and the plate. In fact, some precipitators incorporate a grid structure that contains barbed wire such as DRAGON'S TEETH electrodes or special pointed rods, specifically to enhance such sparking. The sparking inside a precipitator is believed to be necessary as an indicator that the maximum possible current is being drawn, and therefore that the maximum possible ionization of the gases and particles is taking place. In fact, the practice of encouraging sparking is emphasized, even though it is known that sparking produces stresses upon the electrical components of the system, it causes increased precipitator maintenance because of the production of agglomerated particles, sometimes called "ash balls" or "klinkers," and it also causes difficulty in insuring that the rappers, which are devices that vibrate the precipitator plates to remove collected particles, are in fact operative and are removing collected particulate material.

A problem that results from operating an electrostatic precipitator as levels at which sparking occurs is the prevention of damaging arcing. An automatic controller for the input power to the T/R set must sense incipient arcing and immediately reduce the voltage on the precipitator collector plate, because any spark can quickly create an arc between the plate and the electrode, with a resultant high current flow. The high current flow can cause severe damage to the precipitator grid or plate. Additionally, arcing can cause the T/R set to fail, it can cause the controller to fail, or it can open the overcurrent protectors that are provided in the incoming power line. Any of those incidents will cause a section of the precipitator to be temporarily off-line, with the resultant undesirable passing of greater amounts of particulates into the atmosphere until the damage to the precipitator has been repaired. Repair can be a matter of minutes, or it can be weeks if the T/R set or controller has to be replaced.

Heretofore, the prevention of arcing has been attempted by providing complicated sensing and control circuits that add expense to the cost for an electrostatic precipitator. Examples of such circuits are shown in U.S. Pat. Nos. 4,290,003, which issued on Sep. 15, 1981, to Philip M. Lanese; 4,390,831, which issued on Jun. 28, 1983, to William Byrd et al.; 4,587,475, which issued on Oct. 19, 1993, to Gugliemo Liberati. However, the presently available circuits, although effective to some degree, still permit sparking and arcing to occur, thereby requiring more frequent maintenance of the precipitator to repair the damage that is caused by such sparking and arcing. Maintenance involves down time for the precipitator, and usually for the system in which the precipitator is installed, thereby increasing the cost for producing the product of the system in which the precipitator is employed.

In many electrostatic precipitators sulfur trioxide or ammonia, or both, must be injected into the gas stream in order to keep the opacity of the stack gases as low as possible. However, the use of such gases is undesirable because of their caustic nature, that over time causes damage to the precipitator and the stack, again necessitating repair and consequent down time of the process or equipment with which the precipitator is employed.

It is an object of the present invention to provide a higher electrostatic precipitator output voltage, having a reduced voltage ripple and high frequency energy to reduce the occurrence of sparks and arcs, and thereby improve the precipitator performance.

It is also an object of the present invention to reduce the power consumed by the electrostatic precipitator by reducing the rate of arcs and sparks.

It is a further object of the present invention to provide an apparatus that can be readily incorporated into existing electrostatic precipitator circuits to improve their efficiency of operation by reducing the occurrence of arcs and sparks.

It is another object of the present invention to provide an apparatus that helps the precipitator to operate more efficiently and more effectively which will cause the resultant opacity of stack emissions from coal-fired, and other fossil fuel boilers to be reduced. The use of this apparatus will reduce the need to use caustic gases that might otherwise be required to meet air quality limits and opacity level maximums as specified by regulatory agencies.

SUMMARY

The present invention is directed to a method and apparatus that satisfies these needs. The method and apparatus comprises electrically connecting a two stage inductor assembly along the bus between the power supply and electrodes of an electrostatic precipitator. The inductor assembly has a first inductor member and a second inductor member. The first inductor member is defined by a plurality of turns of a continuous length of wire. The second inductor member is defined by a plurality of ferrite beads positioned in end-to-end relationship. These and other features, aspects, and advantages of the present inventions will become better understood with reference to the following drawings and description.

DRAWINGS

Figure 2:
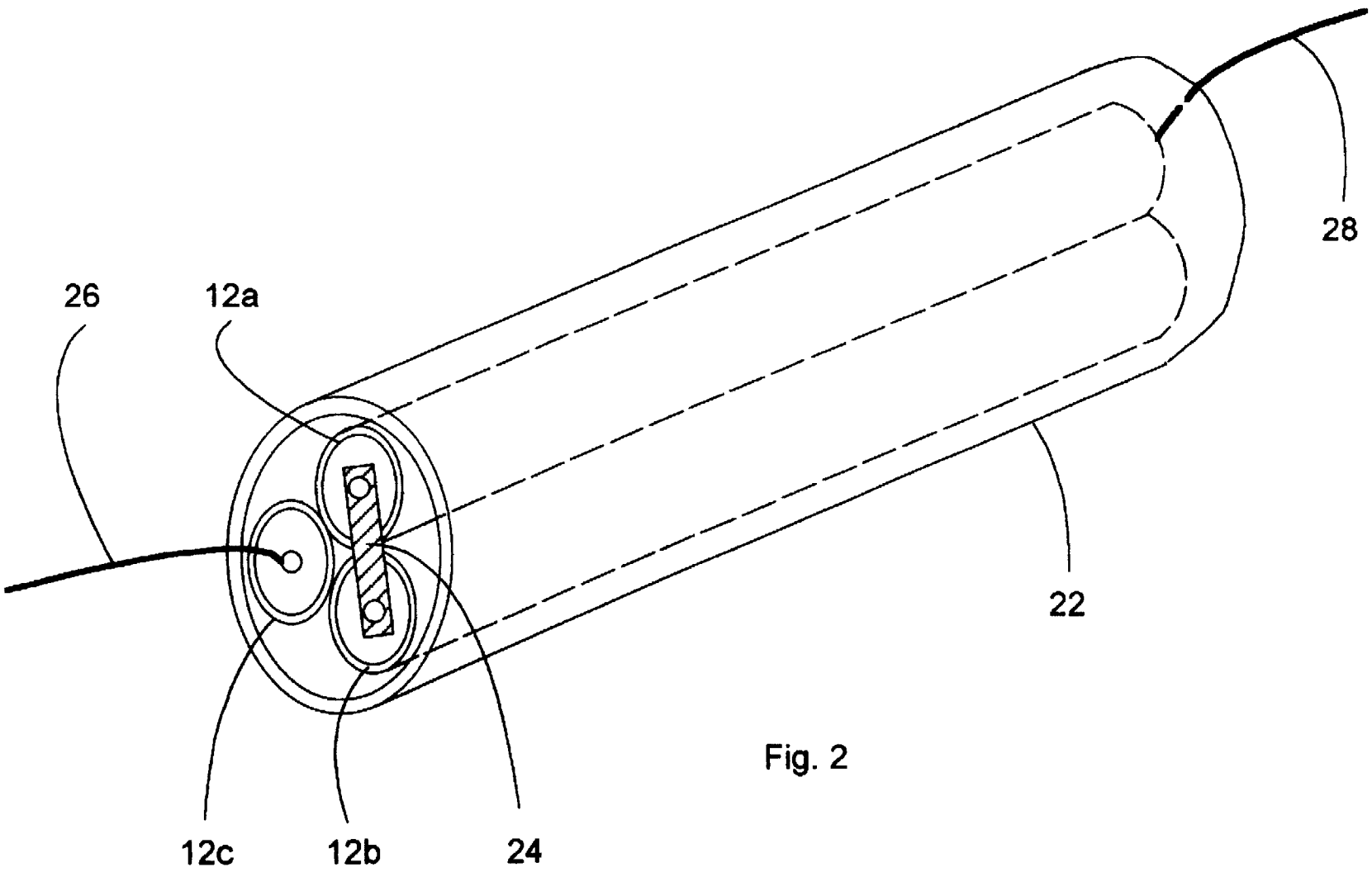
FIG. 2 shows an embodiment where three second inductor members are carried inside a tubular body member.
Figure 4:
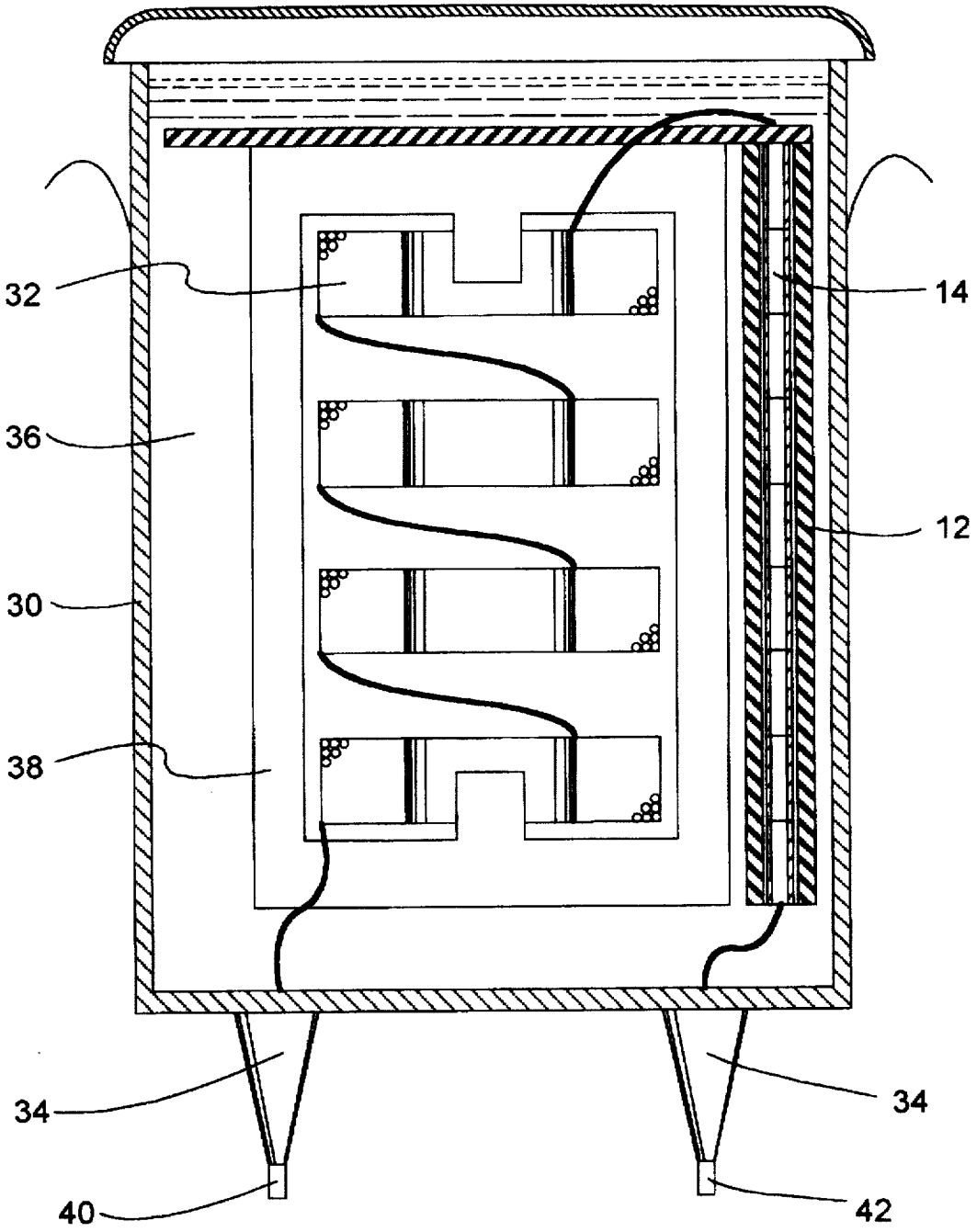

FIG. 4 a cut away side view of an embodiment similar to that in FIG. 2, but including a conductive metal core surrounding the first inductor member and a second inductor inside the can.

Figure 5:
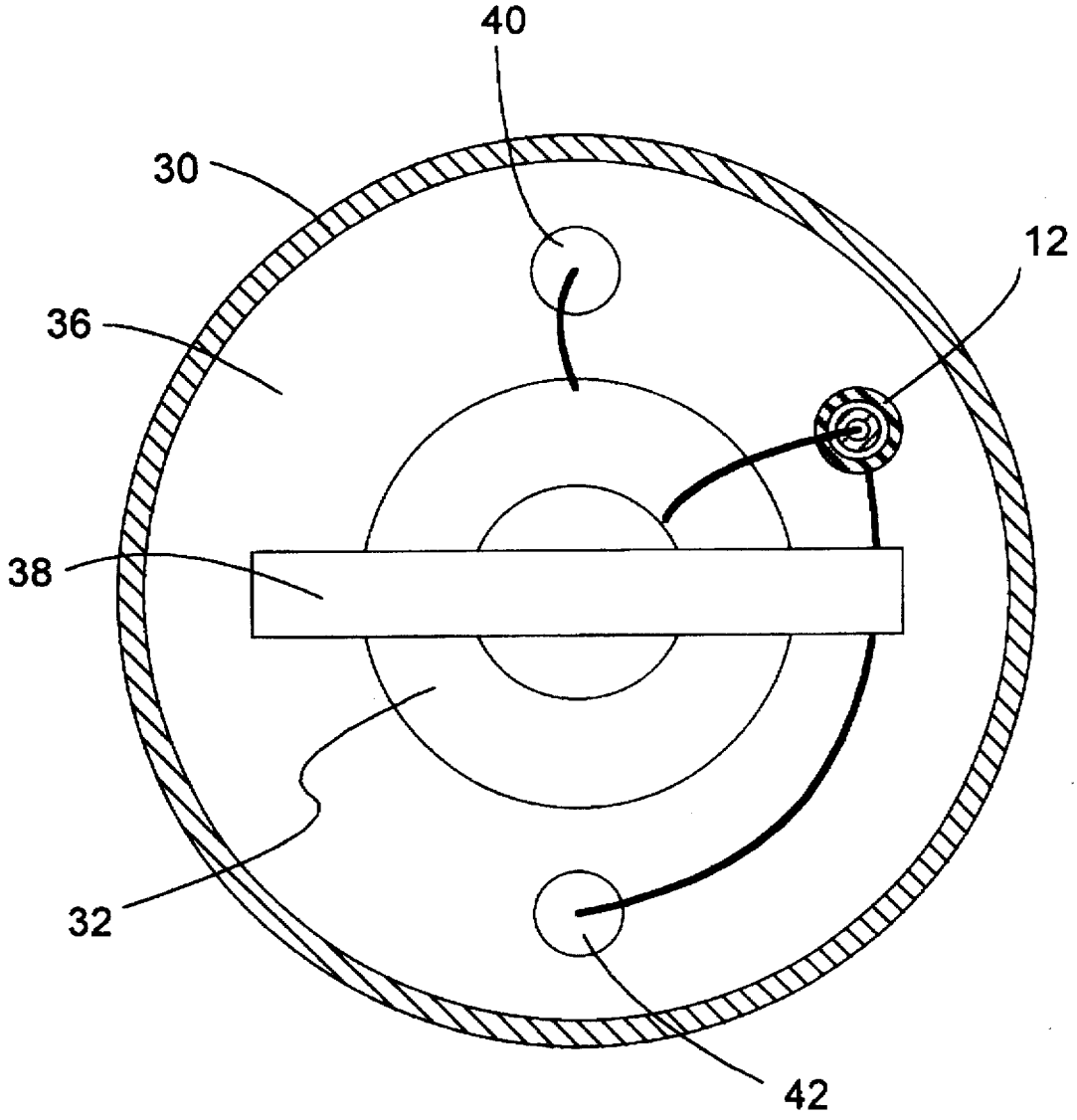

FIG. 5 is a top view of the embodiment of FIG. 4.

Figure 6:
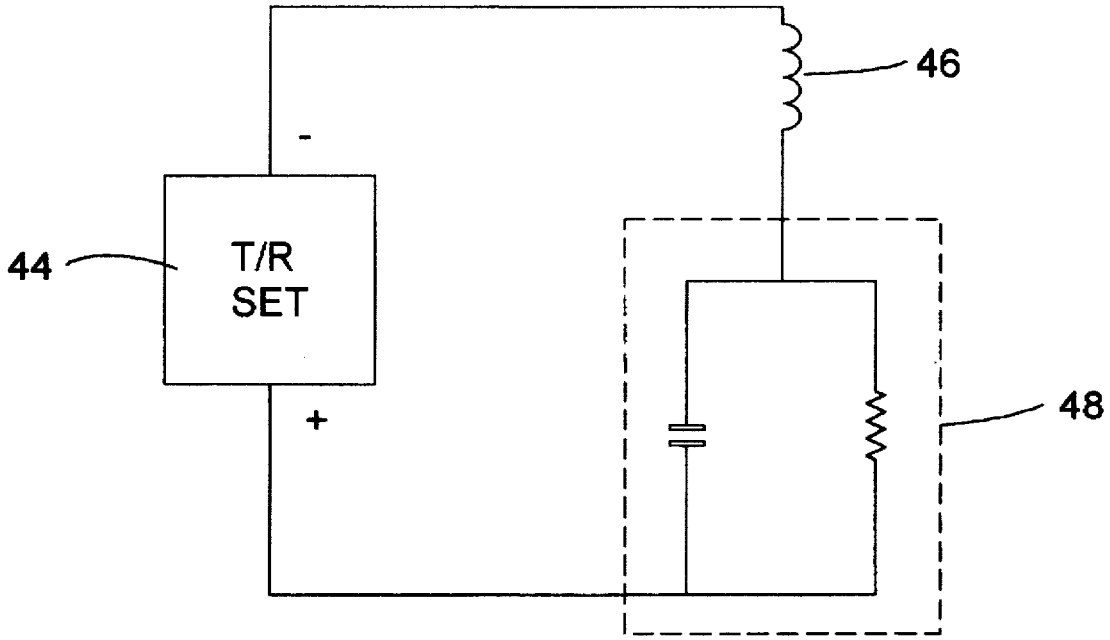

FIG. 6 is a schematic electrical diagram of the T/R set and precipitator with the inductor assembly installed.

DESCRIPTION

The present invention is a method and apparatus for increasing the collection efficiency and reducing the power consumption of an electrostatic precipitator. The present invention is also for absorbing high frequency energy present in the power supplied to the precipitator so that the incidence of arcing and sparking is reduced, which improves collection efficiency while reducing maintenance costs.

The principle of operation for increasing the collection efficiency and reducing power consumption is to change the electrical characteristics of the power supplied to the precipitator electrodes. The most prevalent type of power supply in use rectifies AC power using a single phase, full-wave bridge rectifier on the secondary of a high voltage transformer to create DC power. The power supply output is connected by a bus to one or more electrostatic precipitator (ESP) electrodes.

Although the output power is generally referred to as DC, full-wave bridge rectified power actually has a very large AC voltage ripple component that can be mathematically calculated to be as high as 48% of RMS voltage. This ripple had been considered to be an acceptable byproduct by most people skilled in the art. However, the present invention embodies the new theory that higher voltage with less ripple will dramatically increase collection efficiency without requiting more power. In fact, the current and thus power supplied to the ESP can actually be reduced by between about 25 and about 50%. This is a surprising and unexpected result. In practice, the two-stage, high voltage inductor assembly has typically reduced stack opacity between about 30 and about 50% after its installation.

Turning to FIG. 6, an ESP circuit can be modeled by a T/R set power supply 44, which supplies negative DC high voltage to the ESP box 48. The ESP box 48, which comprises a series of electrode wires spaced between collecting plates inside a large box to contain the flow of flue gas from a boiler to a stack, can be modeled as a capacitor and a resistor connected in parallel. The resistive element exists even though there is an air gap between the electrodes and the plates because at high voltages some current does flow through the air from the electrode to the plate. The capacitive element exists because the electrodes and plates hold a capacitive charge due the DC voltage ripple. Under the superposition theorem, the circuit can be analyzed for separate AC and DC operation. This analysis requires a capacitor (C) and resistor (Rp) be connected in parallel and another resistor (Ra) be placed in series with the capacitor.

In a capacitor in an AC circuit, the voltage lags the current by 90 degrees. When combined with the effect of the resistor, the resultant power factor of the power at the ESP is less than one. This represents a loss of efficiency.

The inductor (L) 46 in FIG. 6 represents the first inductor member of the two-stage, high voltage inductor assembly. It is defined by a plurality of turns of a continuous length of wire, i.e. one or more coils. In an inductor in an AC circuit, the voltage leads the current by 90 degrees. When combined with the effect of the capacitor, the inductor 46 will reduce the phase angle of the power supplied to the ESP and tend to increase the power factor. This will also increase the resultant DC voltage applied to the ESP electrodes. By measuring the electrical characteristics of the ESP, values for the resistance and capacitance of each individual ESP can be determined. However, these values may change over time due to temperature, humidity, fly ash accumulation on the plates, and actual voltage levels. Therefore, average representative values must be determined from the data. Once values for resistance and capacitance have been determined, the proper inductance can be calculated using vector analysis. The proper size and number of coils necessary to achieve the desired inductance is then determined by methods known to those skilled in the art.

In the event of an are or spark when the two-stage, high voltage inductor assembly is installed, the first inductor member acts to impede fast change in current flow. When an arc occurs, the full voltage short does not appear at the T/R set, so large currents usually produced do not occur. The T/R experiences a more controlled change in current flow during and after the short. The T/R does not experience rapid switching from full-scale output to zero, and damaging power surges are avoided. Maintenance costs are reduced, and more uniform operation occurs.

Due the presence of various circuits present in most commercially available T/R sets, high frequency, high voltage spikes are created and transmitted to the ESP electrodes. Sometimes this energy exists at the "tinging frequency" of the equipment, and is difficult to detect and measure without equipment built specifically for the task. Therefore, many users and manufacturers of ESP's are not even aware of its existence.

This high frequency energy causes are leaders to form from the ESP electrodes. These arc leaders represent an ionization of the air inside the ESP between the electrodes and the plates and make the occurrence of an are or spark much more likely. During an are or a high spark rate, the voltage potential between the electrode and plate goes to zero, and no fly ash from the boiler is collected. Arcs and sparks increase the power produced by the T/R set to its maximum capability until the power supply controller can sense an arc or spark and shuts down the input current to the T/R set. This process which can repeat up do dozens of times per minute, can cause damage the circuit elements within the T/P, set, the rectifiers, and other electrical equipment in the circuit. The damage is expensive to repair, and may keep equipment out of service for weeks if an entire T/R, set has to be replaced. This can require the power station to reduce its generation capacityso as not to exceed opacity limits whenever a T/R set is out of service.

Ferrite beads have been used in the past to protect other types of circuits, for example in electrical relays or in transistor circuits. They are inductors that absorb high frequency energy. Their quantity and size is selected according to the impedence required. However, it has not been found in the prior art that ferrite beads can also be used in high voltage, high current applications like that of an ESP circuit in FIG. 6. Their applicability in this type of circuit is a surprising and unexpected result.

In the present invention, the second inductor member of the two-stage, high voltage inductor assembly is defined by a plurality of ferrite beads in end-to-end relationship. The beads are typically cylindrical in shape, having a hole through the center along the longitudinal axis. The beads can be strung on a rigid or flexible conductor, such as a brass rod or copper rod, or can be strung on a flexible conductive wire. In the preferred embodiment, the beads are strung on a brass rod, and secured between each end. The assembly is then secured inside a non-conductive, high dielectric tube, typically made of epoxy-impregnated fiberglass or phenolic. The ends of the brass rod define the electrical terminals of the second inductor member.

FIGS. 1 through 5 show different embodiments of the two-stage, high voltage inductor. They are selected in accordance with 1) the mount of impedance (inductive and resistive) needed from each inductor member, and 2) the physical space available near the individual ESP. Although the drawings show that the first and second inductor members are connected in series, multiple assemblies will also operate when connected to feed parallel ESP sections.

Figure 1:
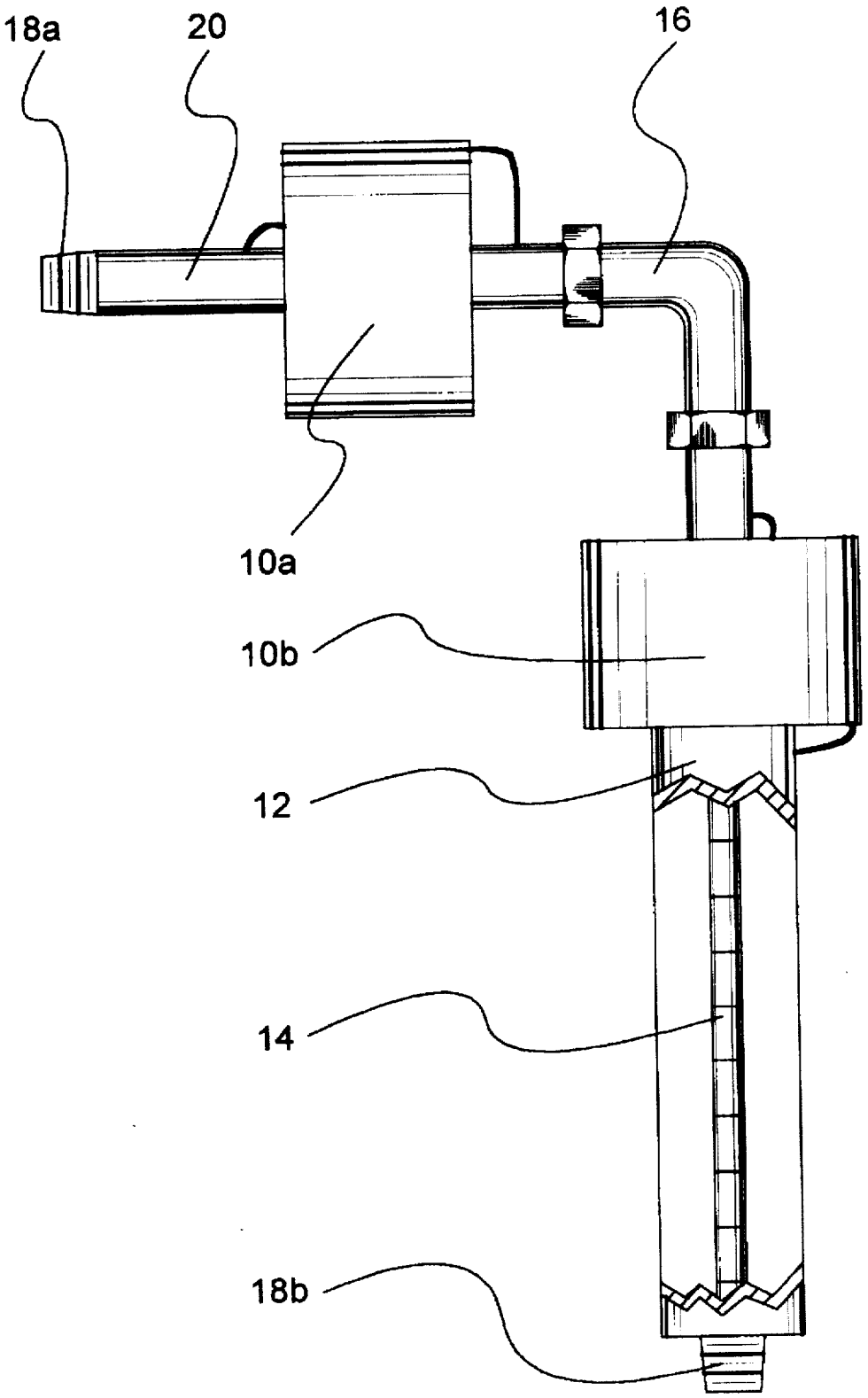
FIG. 1 is an arrangement view of a two-stage inductor assembly having two first inductor members.

FIG. 1 is an embodiment that can be installed in an existing bus duct between the T/R set and ESP electrode input. The output of the T/R set is electrically connected to conductive fitting 18*a*, that ordinarily has a pipe thread and is ordinarily made of brass or other conductive material. The fitting 18*a* is mechanically connected to a tubular, non-conductive body member 20 that supports a first inductor member 10*a*. In this embodiment, the first inductor member 10*a* is an epoxy-impregnated coil of wire. The coil 10*a* is electrically connected to the fitting 18*a* by a conductive wire or bus carried inside the body member 20 to the input terminal of the first inductor member 10*a*. The output terminal of one first inductor member 10*a* is electrically connected to the input terminal of another first inductor member 10*b*. The output terminal of one inductor 10*a* is strung through the body member 16 and through a coupling (either straight or 90 degree elbow), which can be a brass, copper, steel, or iron plumbing fitting. Alternatively, the inductor output could be electrically connected to another conductive fitting which is then connected to a conductive coupling. The purpose of the 90 degree coupling is to enable installation of an inductor assembly inside a duct that has a 90 degree bend, and to enable the installation of a plurality of first inductor members in the same duct. The connector can be straight, or bent at other angles. In this manner, any number of first inductor members can be connected to achieve the inductance required.

The output of the second first inductor member 10*b* is electrically connected to a terminal of a second inductor member 12, that is shown carded inside a non-conductive, high dielectric tubular body member. A plurality of ferrite beads 14 smmg in end-to-end arrangement is shown in cut-away view. An output terminal of the second inductor member is connected to a conductive fitting 18*b*, which is ordinarily made of brass and has a pipe thread (or other means that can create an electrical connection) on the end for connection to the bus leading to the input of an electrostatic precipitator electrode.

FIG. 2 shows an embodiment of the second inductor member only. In some applications, an insufficient space is available in the duct to install the number of ferrite beads required. This problem is solved by aligning a plurality of second inductor members, such as the three shown as 12*a*, 12*b*, and 12*c*, and electrically connecting them in series or in parallel using jumpers 24. A plurality of second inductor members may also be required in applications where high power conditions may saturate a single run of ferrite beads. The second inductor members are carried inside another larger, tubular, non-conductive body member 22. An input terminal 26 of one second inductor member serves as the input to the assembly, and the output terminal 28 of the last second inductor member in series serves as the output of the assembly. In the same way, first inductor members may also be joined in parallel to achieve a higher inductance than would be possible with a single first inductor.

Figure 3:
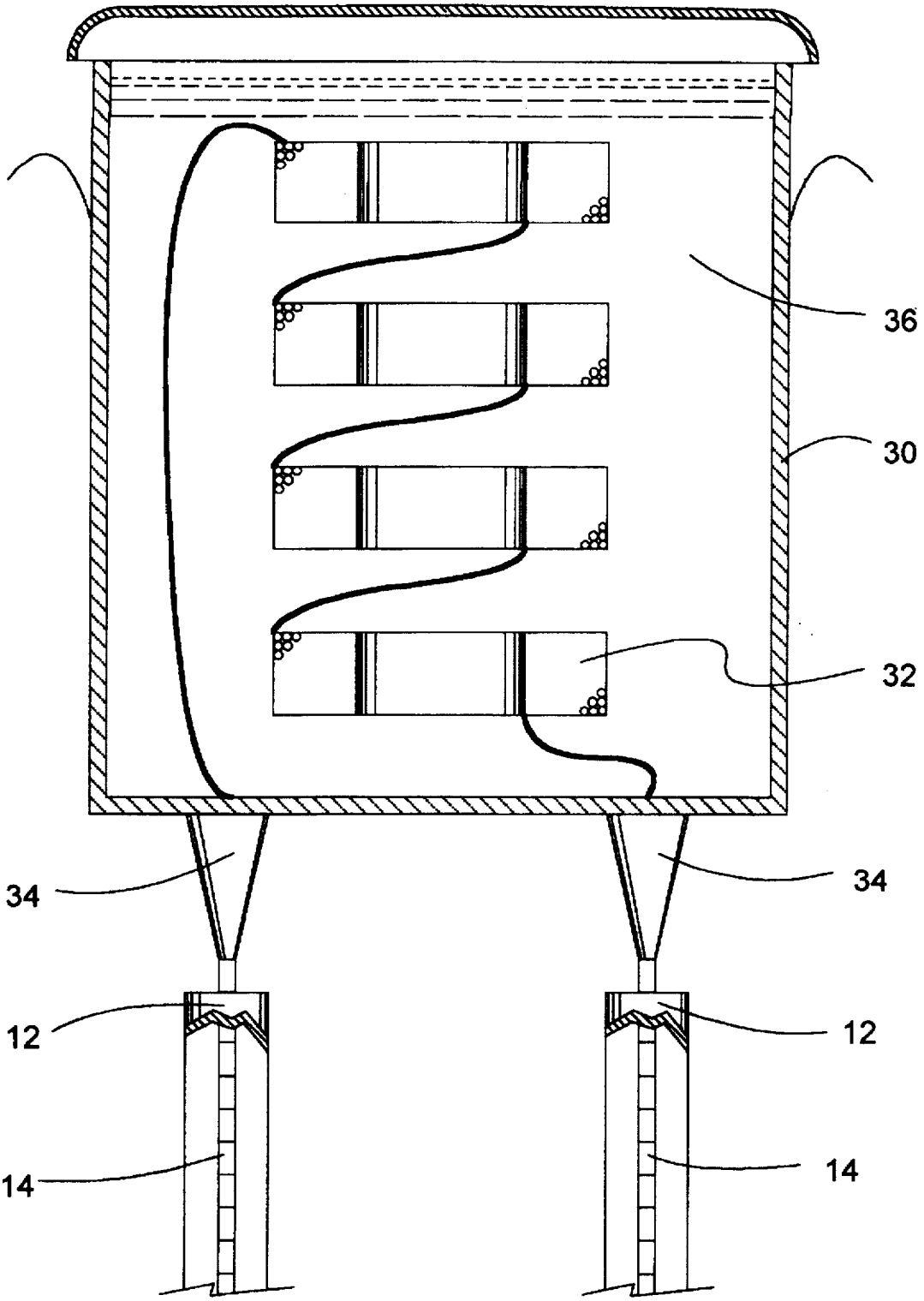
FIG. 3 is a cut-away side view of another embodiment showing the four first inductor members in an oil-filled can, with two second inductor members.

The embodiment shown in FIG. 3 is for applications which require more inductance than can be obtained by epoxy-impregnated coils, such is 10*a* and 10*b* in FIG. 1. In this embodiment, at least one first inductor member 32 is secured inside a tank assembly 30 that is filled with a high-dielectric transformer oil 36. The tank 30 can be the same as mounted on utility poles and is used by power companies to step down voltage supplied to electricity customers. It typically comprises a cylindrical can having a bottom, a lid, a gasket disposed between the lid and the can, and a fastening means. The fastening means is typically a clamping ring shaped like a clam shell that increases the force of the lid on the gasket and can as the ring is drawn tighter. The transformer oil 36 is likewise the same as is used in utility applications.

Two feed through insulators 34 are secured, for example, by welding to the tank assembly 30. The insulators 34 are preferably made of multi-fluted ceramic insulating material capable of insulating high voltages, with steel flanges and terminals.

One or more second inductor members 12 can be mechanically and electrically connected to the insulators 34. One side is connected to the output of the T/R set, and the other is connected to the input of the ESP electrode. A plurality of ferrite beads 14 inside the second inductor assembly 12 is shown in cut away view.

The number and size of first inductor members 32 is selected according to the amount of inductance required. They are spaced from the side of the tank 30 to prevent arcing from the inductor 32 through the oil 36 to the tank 30 when at full load. The first inductor members 32 need not be impregnated in epoxy, but can be a plurality of turns of a continuous length of wire separated by insulating paper or other insulating means.

The structural supporting members and insulation inside the tank 30 is not shown, since such mechanical supporting mechanisms are well known in the art. They are preferably constructed from non-conductive materials such as epoxy-impregnated fiberglass, phenolic, wood, or paper.

FIGS. 4 and 5 show the embodiment of FIG. 3 with the addition of a magnetic steel core 38 surrounding the first inductor member 32. The core serves to concentrate the flux lines of the electrical field surrounding the first inductor 32, thereby increasing the inductance of the assembly. It is most suitable for application requiring the greatest amount of inductance. In the preferred embodiment, the core 38 surrounds the first inductor members 32, and extends at least partially into the center axis, depending on the amount of inductance required. The core 38 is preferably made of a plurality of overlapping laminations of magnetic steel. The laminations are secured together by a welded frame assembly or other securing means.

Some applications have insufficient space to install the second inductor member separately from the first inductor member. In the embodiment shown in FIG. 5, at least one second inductor member 12 is secured in a spaced arrangement inside the tank 30 between the first inductor member 32 to prevent arcing between them through the transformer oil 36. The mechanical support structure is not shown. Second inductor members 12 may also be secured inside the can of the embodiment shown in FIG. 3.

In the preferred embodiment, a first feed through insulator 34 is electrically connected by its terminal 40 to the output of a T/R set. The terminal 40 is electrically connected inside the tank 30 to a first inductor member 32. Additional first inductor members 32 may be connected in series. The final first inductor member 32 is electrically connected to a second inductor member 12 inside the tank 30. Additional second inductor members 12 may be connected in series. The final second inductor member 12 is electrically connected to an output terminal 42 of a second feed through insulator 34.

In some applications, one T/R set supplies power to more than one ESP section. For those applications, inductor assemblies can be installed along the bus to each ESP section from the same T/R set output that effectively connects the two assemblies in parallel.

It will be apparent to those skilled in the art that various changes and modifications can be made without departing from the spirit of the present invention. Accordingly, it is intended to encompass within the appended claims all such changes and modifications that fall within the scope of the present invention.

We claim:

1. A two-stage inductor assembly comprising:

a. at least one first inductor member defined by a plurality of turns of a continuous length of wire, and b. at least one second inductor member defined by a plurality of ferrite beads positioned in end-to-end relationship, wherein the first and second inductor members are electrically connected in series between a power supply and at least one electrode of an electrostatic precipitator for increasing voltage, reducing ripple, and absorbing high frequency energy in the power supplied to the electrodes.

2. The inductor assembly of claim 1, wherein said first inductor members are electrically connected in parallel and the second inductor members are electrically connected in parallel.

3. The inductor assembly of claim 1, said ferrite beads aligned in end-to-end relationship having an exterior surface and interior surface that defines an interior volume, said second inductor member further comprising:

a. a tubular, substantially non-conductive body member having a center axis, an exterior surface, and an interior surface that defines an interior volume; and b. a conductive rod, wherein said ferrite beads are carried on said rod and within said body member; said rod having ends that define an input terminal and an output terminal.

4. The inductor assembly of claim 3 further comprising an additional tubular, substantially non-conductive body member having an exterior surface and an interior surface that defines a volume, suitably adapted to carry a plurality of electrically connected second inductor members aligned along their center axes.

5. The inductor assembly of claim 1, wherein said first inductor members are epoxy-impregnated toroidal coils having a central air core.

6. The inductor assembly of claim 1 further comprising:

a. a tank assembly having an interior volume, b. high dielectric transformer oil held within said tank, and c. two feed-through insulators fastened to the outside of the tank, wherein the first inductor members are in a spaced relationship within said tank to prevent arcing through said transformer oil, and wherein the insulators are electrically connected to said first inductor members to define an input terminal and an output terminal and are in a spaced relationship to each other to prevent arcing between them.

7. The inductor assembly of claim 6 further comprising a magnetic steel core surrounding the first inductor member for increasing the inductance of the first inductor.

8. The inductor assembly of claim 7, wherein the magnetic steel core is defined by a plurality of overlapping steel laminations securely fastened together.

9. The inductor assembly of claim 6, wherein the second inductor members are secured within the tank assembly in a spaced relationship between the first inductor members and the tank assembly to prevent arcing through the transformer oil, and wherein one insulator is electrically connected to the first inductor members, the first inductor members are electrically connected to the second inductor members, and the second inductor members are electrically connected to the second insulator.

10. The inductor assembly of claim 7, wherein the second inductor members are secured within the tank assembly in a spaced relationship between the first inductor members and the tank assembly to prevent arcing through the transformer oil, and wherein one insulator is electrically connected to the first inductor members, the first inductor members are electrically connected to the second inductor members, and the second inductor members are electrically connected to the second insulator.

11. The inductor member of claim 6, said tank assembly comprising a rigid, substantially cylindfically-shaped structure having a bottom, a lid, a gasket disposed between the can and the lid, and a fastening mechanism for fastening the lid to the can.

12. The inductor assembly of claim 5, wherein said first inductor members are electrically connected in parallel and the second inductor members are connected in parallel.

13. The inductor assembly of claim 9, wherein said first inductor members are electrically connected in parallel and the second inductor members are connected in parallel.

14. The inductor assembly of claim 10, wherein said first inductor members are electrically connected in parallel and the second inductor members are connected in parallel.

15. A method for increasing the collection efficiency and reducing the power consumption of an electrostatic precipitator having a power supply to supply power to an electrode through a bus, a power supply controller, a bus, at least one electrode, and at least one collecting plate, comprising the steps of a. increasing the power factor and reducing the voltage ripple of the power supplied to the electrode by electrically connecting at least one first inductor member defined by a plurality of turns of a continuous length of wire in series with the bus, thereby increasing the voltage supplied to the electrode and the collection force applied to a stream of particles flowing between the electrode and the plate;

b. absorbing the high frequency energy present in the power supplied to the bus by electrically connecting at least one second inductor member defined by a plurality of ferrite beads positioned in end-to-end relationship in series with the bus and the first inductor member, thereby reducing incipient arcs and sparks between the electrode and the plate during which a stream of particles would flow past uncollected; and c. reducing the current supplied to the electrode by adjusting the power supply controller to a lower setting.

16. The method of claim 15, wherein said first inductor members are electrically connected in parallel and second inductor members are connected to each other in parallel.

17. An electrostatic precipitator power supply circuit comprising a. a power supply electrically connected to a junction, b. a plurality two-stage inductor assemblies electrically connected to the junction comprising: at least one first inductor member defined by a plurality of turns of a continuous length of wire, and at least one second inductor member defined by a plurality of ferrite beads positioned in end-to-end relationship, and c. a plurality of electrostatic precipitator electrodes, wherein the two stage inductor assemblies are electrically connected in series between the single power supply and the plurality of electrodes.

* * * * *